US005385448A

United States Patent [19]

Merkt et al.

[11] Patent Number: 5,385,448

[45] Date of Patent: Jan. 31, 1995

[54] PROPELLER SHAPED AGITATOR

[75] Inventors: Thilo Merkt, Oyten; Horst Schäfer, Rhade; Günter Feldle, Ostfildern-Nellingen; Oskar Gabler, Frankenthal, all of Germany

[73] Assignee: KSB Aktiengesellschaft, Frankenthal, Germany

[21] Appl. No.: 105,041

[22] Filed: Aug. 11, 1993

[30] Foreign Application Priority Data

Aug. 11, 1992 [DE] Germany ..... 4226498

[51] Int. Cl.[6] ..... F04D 29/20

[52] U.S. Cl. ..... 416/229 R; 416/194; 416/241 A; 366/330; 366/331

[58] Field of Search ..... 416/204 R, 208, 229 R, 416/229 A, 241 A, 244 R, 194; 366/270, 330, 331

[56] References Cited

U.S. PATENT DOCUMENTS

| | | | |
|---|---|---|---|
| 1,463,153 | 7/1923 | Clay | 416/229 R |
| 2,636,720 | 4/1953 | Forrest | 416/208 |
| 3,002,266 | 10/1961 | Lynn et al. | 416/204 R |
| 4,251,189 | 2/1981 | Zinsser et al. | 416/241 A |
| 4,762,465 | 8/1988 | Friedrichs | 416/241 A |
| 4,941,750 | 7/1990 | Bouchez et al. . | |
| 5,247,936 | 3/1994 | Sato | 416/204 R |

FOREIGN PATENT DOCUMENTS

| | | | |
|---|---|---|---|
| 0477530 | 10/1915 | France | 416/194 |
| 2462596 | 2/1981 | France . | |
| 29603 | 4/1907 | Germany . | |
| 2240011 | 2/1974 | Germany . | |
| 3941612 | 6/1991 | Germany . | |

*Primary Examiner*—Edward K. Look
*Assistant Examiner*—Christopher Verdier
*Attorney, Agent, or Firm*—Darby & Darby

[57] ABSTRACT

A multibladed propeller shaped agitator includes a plurality of impellers having made blades, blade roots and hub segments made of plastic material. A metallic hub element is inlaid only in the hub segment. The impellers are connected to the hub segment such that stress peaks, imparted from a driving force, in the region of the blades, blade roots and hub segments are substantially prevented.

8 Claims, 1 Drawing Sheet

PROPELLER SHAPED AGITATOR

BACKGROUND OF THE INVENTION

1. Technical Field

The present invention relates to a propeller shaped agitator, in particular to a propeller shaped agitator having blades, blade roots and hub segments.

2. Discussion of the Related Art

In various technical areas agitators are employed for mixing, transporting and retaining of substantially homogeneous fluids. Frequently this involves a multi-bladed propeller shaped agitator the hub of which is coupled to a driving source.

A particular useful process for the circulation of fluids which may also contain solid material, involves the employment of submerged motor agitators. In the case of these agitators a driving motor is directly coupled to a propeller shaped agitator and is totally submerged in the fluid to be agitated. The propeller agitators can hydraulically transfer very high impulse forces, through which it is possible to maintain large basin volumes in continuous motion, as in clarification technology for example. At the same time the solid material particles in the volume of the fluid can be held in suspension thereby, and a settling of these to the bottom of the basin is prevented. Propeller shaped agitators known in the art typically have diameters up to three meters. For ease of fabrication, such propellers are usually made of composite construction, in which the propeller blades are formed as a plastic element. A metallic propeller hub and/or propeller shaft with the help of reinforcing elements, supplies the necessary large driving turning moment to the individual blades. High bending forces are developed in the transition region between the hub element and the blade roots. Not withstanding the use of reinforcing elements in the transition region, there is still a problem of frequent breakage of the propeller blades. The basis then for the present invention is to prevent the breakage of the blades in propeller shaped agitators employing plastic blades and the resulting disadvantages which arise therefrom.

SUMMARY OF THE INVENTION

Through the present invention, even very large and slow running propeller shaped agitators, which are used in clarification applications, exhibit a marked improvement in insensitivity to breakage, compared to solutions previously employed in the art. It is exactly in these very large diameter propeller shaped agitators that very high turning moments occur which result in a strong elastic deformation of the blades. In foregoing the use of reinforcing elements, there results an elastic deformation of the blade over its entire length up to the transition of the blade root into the plastic hub. The present invention recognizes that through built-in reinforcing elements in the blades, which were preferably constructed of metal, stress peaks develop in the transition region between metal and plastic. These invariably lead to ultimate breakage of the blade. By avoiding this type of reinforcement, unacceptable stress peaks in the regions of the blade are prevented. When there is the further guarantee, that through a broad surface area transition of the blade into the blade root and its hub segment, there is a stress peak-free gradient along the lines of force, the lifetime of the blades can be multiplied many times over.

According to an embodiment of the present invention the hub elements are provided with through passage openings for the plastic material of the hub segments, and this helps set the condition for an intimate and problem free transfer of force in this region. The driving turning moment provided directly from the drive shaft of the driving motor or through a transmission is directly coupled to the metallic hub element. Since this is designed to be longer in the axial direction than the blade root attached thereto, the large surface area enveloping the metallic hub element by the plastic hub segment can guarantee a stress point free transfer of the turning moment into the plastic material. The largely stress point free constructed transition from the hub segment into the blade root and from there into the actual blade makes possible a smooth flow of force without the component threatening stress peaks.

It is of course possible for a person of ordinary skill in the art, based on this disclosure, to design the propeller in such a manner that a long operating life even with transmission at high power is guaranteed. Yet it is not possible to prevent such a propeller from being put at risk from solid materials such as driftwood, struts and the like, for example, contained in the medium being agitated. Resulting blade damage from this cause is normally not preventable. However, by means of the construction according to the present invention it is made certain that a blade broken due to outside causes cannot fall into the medium under agitation. A sling, which is applied to the leading and trailing edge regions of the blade, reliably prevents a separation of the blade from the hub. The sling, which may consist of a thin plastic or metal element continues to connect the blade with the hub in the event of blade breakage. Thereby, the broken off part of the blade will not sink to the bottom of the basin. Together with the agitator, it may be lifted out of the medium. For simplicity, the sling may also be made of wire or rope.

BRIEF DESCRIPTION OF THE DRAWINGS

The above and still further objects features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PRESENTLY PREFERRED EXEMPLARY EMBODIMENT

Figure 1:
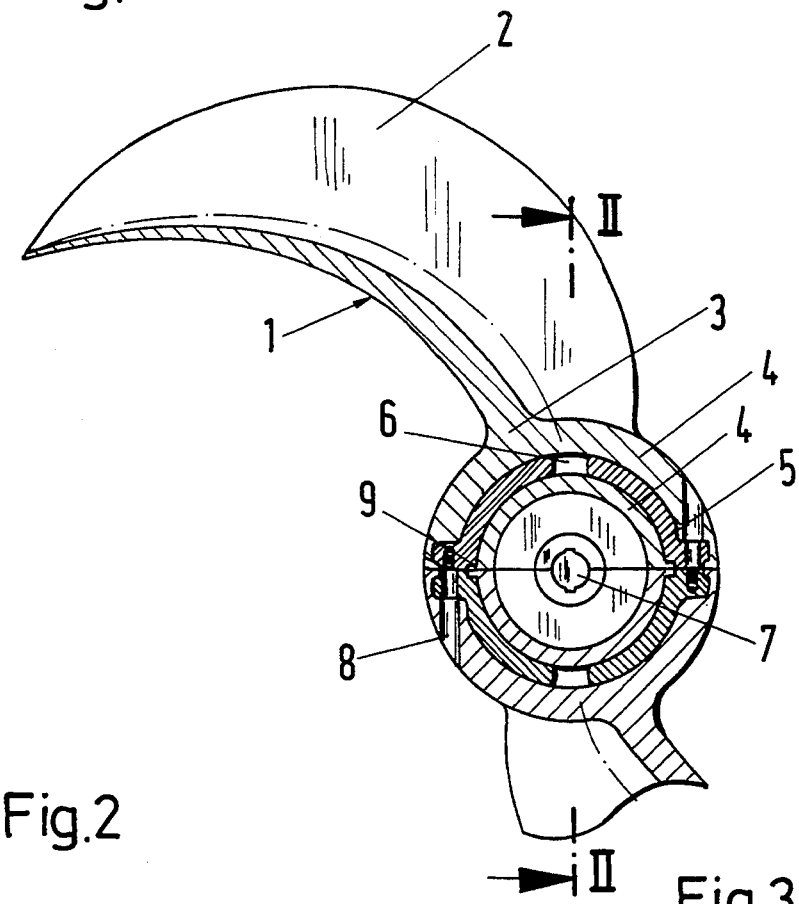
FIG. 1 is a cross-section view of a two bladed propeller shaped agitator in accordance with the present invention.

Shown in the drawings is a two bladed propeller shaped agitator 1 comprising two blade elements that are bolted together. Each blade or impeller element includes a blade 2, a blade root 3 and a hub segment 4. These elements are all preferably made of the same plastic material. A metallic hub element 5 is provided with through passage openings 6 for the plastic material of the hub segment 4. The metallic hub element 5 is located within the hub segment 4 and has a large surface area. A drive shaft 7 supplies the necessary driving moment to the blade. Slot like depressions 9 developed in the region of the flange formed metallic hub elements serve to improve the force transfer between the plastic material and the metal element.

Figure 2:
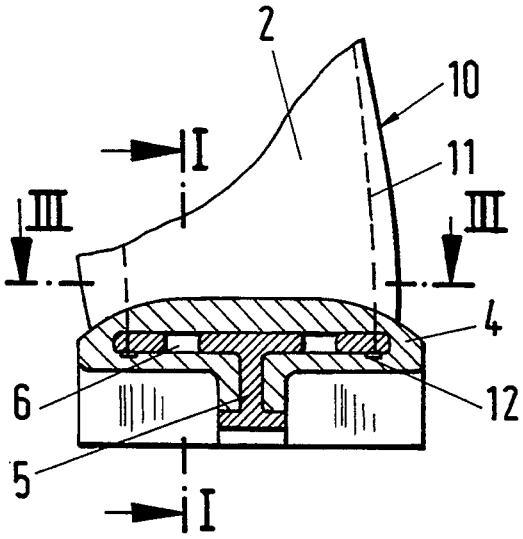
FIG. 2 is longitudinal sectional view of the hub taken along line 2-2 of FIG. 1.

The metallic hub element 5 is developed here as a shell formed in part having a smooth surface in the region of the blade 2 and without projections protruding into the blade. Through this means the development of stress peaks in the transition between the hub 4 and blade 2, and within the blades 2 are effectively prevented. The metallic hub elements 5 are arranged adjacent to one another. The metallic hub elements 5 are flanged together and thus serve to transmit force to the blades 2. Standard fastening means 8 are used to bond the hub segments 4 for force transmission to the shaft 7. The section shown in Fig. 1 corresponds to the sectional course designated I-I in FIG. 2, while FIG. 2 corresponds to the sectional course II-II of FIG. 1. The metallic hub element 5 is almost totally imbedded in the plastic material of hub segment 4. The contact area with the shaft 7 is solely metal to metal, i.e., the metal hub elements 5 contact the metal shaft 7. In the metallic hub element 5, there are arranged a plurality of axially and radially running passthrough bores 6 which guarantee internal contact between the parts i.e., the metal hub elements 5 and the impeller or blade element. A sling 11 is attached along the blade edges 10 of the blade 2, whereby the sling ends 12 are connected with the metallic hub 5. Should the blade break due to external agents, such as driftwood or the like, the sling 11 would prevent the blade 2 from separating from the propeller. A protracted search for a separated blade in the region of the basin bottom is thereby effectively prevented.

Figure 3:
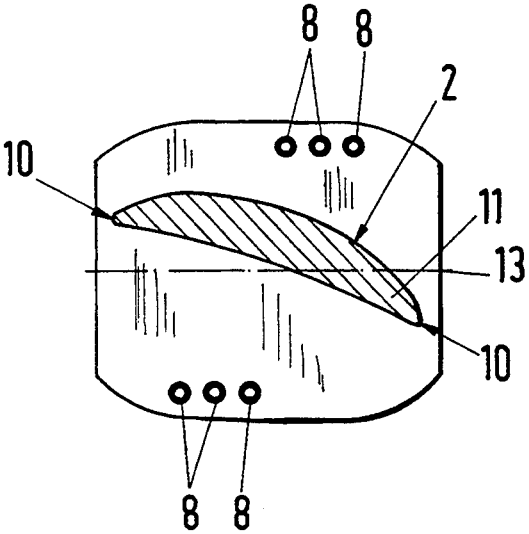
FIG. 3 is a top sectional view taken along line 3-3 of FIG. 2.

Reference is now made to FIG. 3 where a top view of the hub element 4 is shown. The fastening means 8 are spaced from the axis of rotation 13 and are arranged diagonally opposite to each other. By this construction it is possible, through the use of two identical blades, using reversed assembly, to construct a double bladed propeller. Accordingly, for a greater number of blades, the developed angle of the arc of the hub segments is made smaller. This construction provides a significant simplification in the fabrication process, since it is now possible to construct a multibladed propeller from a single blade type.

Having described the presently preferred exemplary embodiment of a new and improved propeller shaped agitator in accordance with the present invention, it is believed that other modifications, variations and changes will be suggested to those skilled in the art in view of the teaching set forth herein. It is therefore to be understood that all such variations, modifications and changes are believed to fall within the scope of the present invention as defined by the appended claims.

We claim:

1. An agitator comprising:

(a) an impeller made of a plastic material, said impeller comprising a plurality of blades, each of said blades comprising a blade root and a hub segment;

(b) a plurality of hub elements made of a metallic material, each of said hub elements being disposed within one of said hub segments, adjacent hub elements being connected to each other such that said hub elements form a means for receiving a rotational driving force; each of said hub elements having a smooth projection free outer surface facing each of said blades and an inner surface facing each of said means for receiving a rotational driving force; and (c) means for connecting each of said impellers to each of said hub elements such that stress peaks, imparted from said driving force, in the region of said blades, said blade roots and said hub segments are substantially prevented.

2. The agitator according to claim 1, wherein said hub elements have through passage openings to receive the plastic material of the hub segments.

3. The agitator according to claim 2, wherein said hub elements have a shell shape, including an outer convex surface and an inner concave surface.

4. The agitator according to claim 3, wherein adjacent hub elements are connected together in flange form.

5. The agitator according to claim 4, wherein adjacent hub elements are connected together by fastening means that are located diagonally across from each other, and are substantially equally offset with respect to an axis of rotation of the agitator.

6. The agitator according to claim 2, wherein the hub elements have a broad surface contact area between the impeller and the hub elements.

7. The agitator according to claim 1 wherein the hub elements comprise a plurality of stacked, radially directed, holding means.

8. The agitator in accordance with claim 1 further comprising a sling assembly introduced along an edge of said blades, the sling assembly having sling ends that are connected to the hub elements.

* * * * *